US011617421B2

(12) United States Patent
Kang

(10) Patent No.: US 11,617,421 B2
(45) Date of Patent: Apr. 4, 2023

(54) CRAMPON WITH EMBEDDED CLEATS

(71) Applicant: Hillsound Equipment Inc., Vancouver (CA)

(72) Inventor: Chang Sun Kang, Vancouver (CA)

(73) Assignee: HILLSOUND EQUIPMENT, INC., Vancouver (CA)

( * ) Notice: Subject to any disclaimer, the term of this patent is extended or adjusted under 35 U.S.C. 154(b) by 0 days.

(21) Appl. No.: 17/285,425

(22) PCT Filed: Oct. 15, 2019

(86) PCT No.: PCT/CA2019/051461

§ 371 (c)(1),
(2) Date: Apr. 14, 2021

(87) PCT Pub. No.: WO2020/077448

PCT Pub. Date: Apr. 23, 2020

(65) Prior Publication Data

US 2021/0337936 A1 Nov. 4, 2021

Related U.S. Application Data

(60) Provisional application No. 62/747,315, filed on Oct. 18, 2018.

(51) Int. Cl.
*A43C 15/06* (2006.01)

(52) U.S. Cl.
CPC ..... *A43C 15/061* (2013.01)

(58) Field of Classification Search
CPC ..... A43C 15/06; A43C 15/061; A43C 15/063; A43C 15/065; A43C 15/066; A43C 15/068; A43B 3/16; A43B 3/18
See application file for complete search history.

(56) References Cited

U.S. PATENT DOCUMENTS 3,040,450 A * 6/1962 Phillips ..... A43C 15/162 264/261
3,461,576 A 8/1969 Hubbard
3,838,528 A 10/1974 Johnson
4,306,360 A * 12/1981 Hagger ..... A43B 5/001 36/134
5,029,405 A * 7/1991 DeHaitre ..... A43C 15/162 36/134
D327,975 S 7/1992 Saito
D341,480 S 11/1993 Saito
D341,704 S 11/1993 Saito
(Continued)

FOREIGN PATENT DOCUMENTS

CN 100411561 A 7/2006
CN 105072940 A 11/2015
(Continued)

*Primary Examiner* — Ted Kavanaugh
(74) *Attorney, Agent, or Firm* — D'Ambrosio & Menon, PLLC; Usha Menon

(57) ABSTRACT

A crampon includes a crampon base for fitting to an underside of an item of footwear, such as a shoe or a boot. A harness extends from the crampon base and may be attached to the crampon base using rivets. The harness and the crampon base define a space for receiving the item of footwear. The crampon base comprises at least one cleat assembly with a cleat base embedded within the crampon base. One or more spikes extend from the cleat base.

22 Claims, 9 Drawing Sheets

(56) References Cited

U.S. PATENT DOCUMENTS

| | | | | |
|---|---|---|---|---|
| D341,705 | S | 11/1993 | Saito | |
| D341,938 | S | 12/1993 | Saito | |
| D342,151 | S | 12/1993 | Saito | |
| D342,152 | S | 12/1993 | Saito | |
| 5,689,901 | A | 11/1997 | Bell | |
| D399,647 | S | 10/1998 | Hikita | |
| D405,249 | S | 2/1999 | Hikita | |
| 6,256,908 | B1 | 7/2001 | Warner | |
| 6,742,286 | B2 | 6/2004 | Giovale | |
| 7,089,688 | B2 | 8/2006 | Giovale | |
| 7,461,467 | B2 | 12/2008 | Park | |
| 7,707,749 | B2 | 5/2010 | Giovale | |
| 8,061,062 | B2 | 11/2011 | Giovale | |
| D655,903 | S | 3/2012 | Kang et al. | |
| 8,661,708 | B2 | 3/2014 | Park | |
| D732,274 | S | 6/2015 | Kang | |
| D732,275 | S * | 6/2015 | Kang | D2/768 |
| D732,276 | S | 6/2015 | Kang | |
| 9,565,890 | B2 | 2/2017 | Walsh | |
| 2004/0045190 | A1 | 3/2004 | Washburn | |
| 2008/0301973 | A1 | 12/2008 | Lee Tsai | |
| 2013/0180130 | A1 | 7/2013 | Giovale | |
| 2014/0196320 | A1 | 7/2014 | Larson | |
| 2015/0143719 | A1 | 5/2015 | Fosbrook | |
| 2015/0230561 | A1 | 8/2015 | Bunch | |
| 2016/0144266 | A1 | 5/2016 | Dussault | |
| 2017/0150774 | A1 | 6/2017 | Girard | |
| 2018/0070680 | A1 * | 3/2018 | Smith | A43B 3/18 |

FOREIGN PATENT DOCUMENTS

| | | | | |
|---|---|---|---|---|
| DE | 20200954 | U1 | 5/2002 | |
| EP | 2666382 | A1 | 11/2013 | |
| EP | 2820966 | A1 | 1/2015 | |
| EP | 2893827 | A2 * | 7/2015 | A43C 15/02 |
| FR | 2699375 | A1 | 6/1994 | |
| KR | 20060079956 | A * | 7/2006 | |
| KR | 100916492 | B1 | 9/2009 | |
| KR | 20160054220 | A | 5/2016 | |
| KR | 200484179 | U | 3/2017 | |
| TW | M508933 | U | 9/2021 | |
| WO | 02/13643 | A1 | 2/2002 | |

* cited by examiner

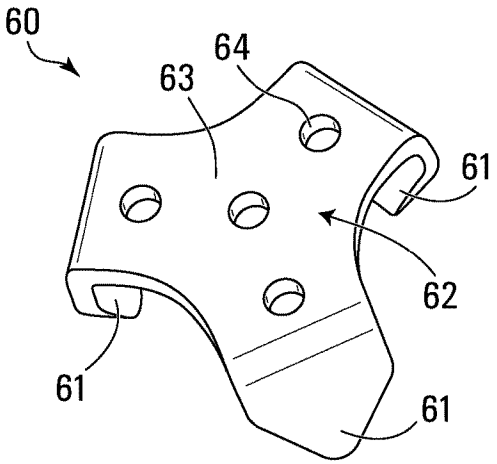
FIG. 5B
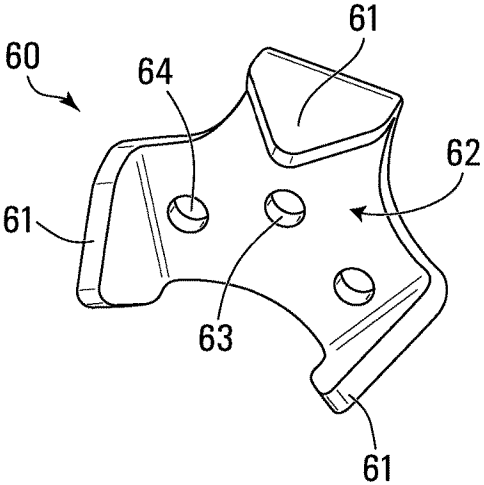
FIG. 5A
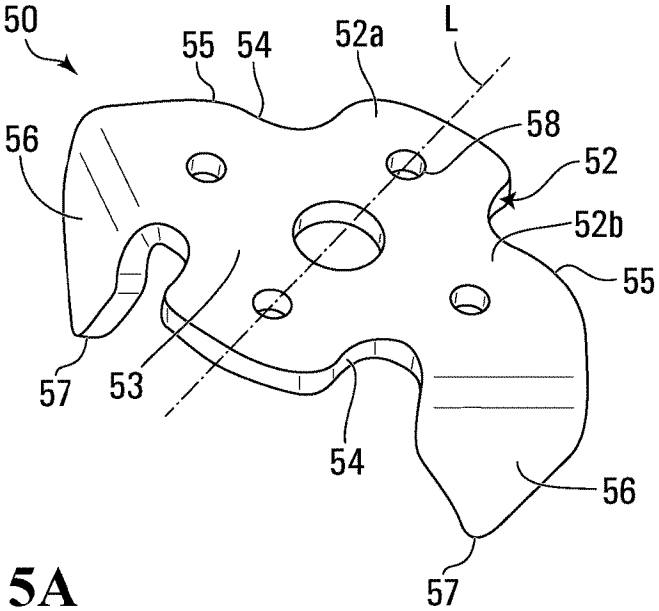
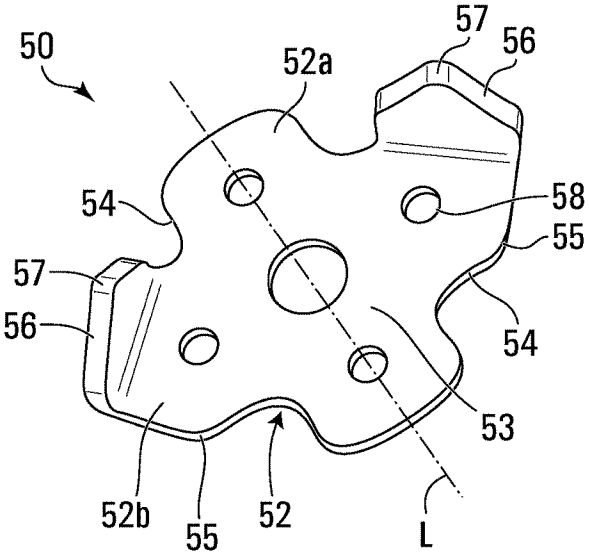

CRAMPON WITH EMBEDDED CLEATS

FIELD OF THE DISCLOSURE

The present disclosure relates to a crampon and to a method of making a crampon.

BACKGROUND TO THE DISCLOSURE

Crampons are devices configured to fit over a user's shoe or boot and to provide improved traction, especially over icy or snowy terrain. Typically, a crampon comprises a base for fitting underneath the user's footwear, and means, such as straps, for attaching the base to the user's footwear. Cleats are provided on the underside of the base for improving traction and grip with the ground.

Crampons come in various shapes and sizes, from mountaineering crampons designed to withstand the rigors of travelling over snow and ice when navigating in the mountains, to simpler devices designed to improve traction and mobility in more urban environments. Given the competing desires for crampons that are both effective in providing improved traction and grip for the wearer, as well as being comfortable for the wearer, there remains a need in the art for an improved crampon that meets a balance between these benefits.

The present disclosure seeks to provide improvements to existing crampons.

SUMMARY OF THE DISCLOSURE

In a first aspect of the disclosure, there is provided a crampon comprising: a crampon base for fitting to an underside of an item of footwear; and a harness extending from the crampon base and defining with the crampon base a space for receiving the item of footwear. The crampon base comprises at least one cleat having: a cleat base embedded within the crampon base; and one or more spikes extending from the cleat base.

The cleat base may be cross-shaped.

The one or more spikes may comprise a pair of spikes.

The cleat base may comprise a central portion and arms extending from the central portion, and each spike may extend from an end of one of the arms. The cleat base may comprise four arms extending from the central portion and at right angles to adjacent arms, and each spike may be angled relative to a line defined by a pair of opposing ones of the arms. The one or more spikes may comprise a pair of spikes extending from ends of opposing ones of the arms. Each spike may extend perpendicularly from an end of one of the arms. At least one of the arms may comprise a linear portion extending from the central portion and a curved portion extending from the linear portion. One of the one or more spikes may extend from an end of the curved portion.

The cleat base may comprise one or more apertures formed therein.

The harness may be attached to the crampon base using one or more fasteners. The one or more fasteners may comprise one or more rivets. The crampon base may further comprise one or more base straps each attached to the harness, and a thickness of at least one of the one or more base straps may increase towards an end of the at least one base strap.

The crampon may further comprise a connector attached to opposite sides of the harness and configured to tighten the harness about the item of footwear. The connector may comprise a Velcro® strap.

The crampon base may comprise a front crampon base portion for fitting to a sole of the item of footwear, and a rear crampon base portion for fitting to a heel of the item of footwear. The crampon base may comprise five cleats partially embedded in the front crampon base portion, and four cleats partially embedded in the rear crampon base portion. The front crampon base portion and the rear crampon base portion may comprise respective base straps attaching the crampon base to the harness, and at least one of the base straps of the front crampon base portion may overlap with at least one of the base straps of the rear crampon base portion.

The crampon base may be molded around the cleat base.

The crampon base may comprise a first elastomer, and the harness may comprise a second elastomer different from the first elastomer. The first elastomer may be more durable and/or less flexible than the second elastomer.

In a further aspect of the disclosure, there is provided a method of making a crampon. The method comprises: positioning one or more cleats in one or more predetermined positions, wherein each cleat comprises a cleat base and one or more spikes extending from the cleat base; and molding a crampon base around the one or more cleats such that each cleat base is embedded within the crampon base.

Molding the crampon base may comprise: positioning an upper crampon base portion over a top side of each cleat base; and molding a lower crampon base portion against a bottom side of each cleat base. The upper crampon base portion may be harder than the lower crampon base portion.

The method may further comprise attaching a harness to the crampon base. When attached, the crampon base and the harness may define a space for receiving an item of footwear.

In a further aspect of the disclosure, there is provided a crampon base for fitting to an underside of an item of footwear. The crampon base comprises at least one cleat having: a cleat base embedded within the crampon base; and one or more spikes extending from the crampon base. The crampon base may comprise one or more of a front crampon base portion for fitting to a sole of the item of footwear, and a rear crampon base portion for fitting to a heel of the item of footwear.

In a further aspect of the disclosure, there is provided a kit of parts. The kit of parts comprises: a harness; a crampon base for fitting to an underside of an item of footwear, comprising at least one cleat having: a cleat base embedded within the crampon base; and one or more spikes extending from the cleat base; and one or more fasteners for attaching the harness to the crampon base, wherein, when attached to each other, the harness and the crampon base define a space for receiving the item of footwear.

In a further aspect of the disclosure, there is provided a cleat for a crampon. The cleat comprises: a cleat base having a central portion and arms extending from the central portion; and one or more spikes, each spike: extending from an end of one of the arms; and angled relative to a line defined by a pair of opposing ones of the arms.

BRIEF DESCRIPTION OF THE DRAWINGS

Example embodiments of the disclosure will now be described in conjunction with the accompanying drawings of which:

FIGS. 5A and 5B show cleats according to embodiments of the disclosure;

DETAILED DESCRIPTION OF EMBODIMENTS

The present disclosure seeks to provide an improved crampon and a method of making such a crampon. While various embodiments of the disclosure are described below, the disclosure is not limited to these embodiments, and variations of these embodiments may well fall within the scope of the disclosure which is to be limited only by the appended claims.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending in the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context.

The terms "front", "rear", "top", "bottom", "left" and "right" are to be interpreted as a user of a crampon would interpret such terms, with the crampon attached to an item of footwear worn by the user.

Figure 1:
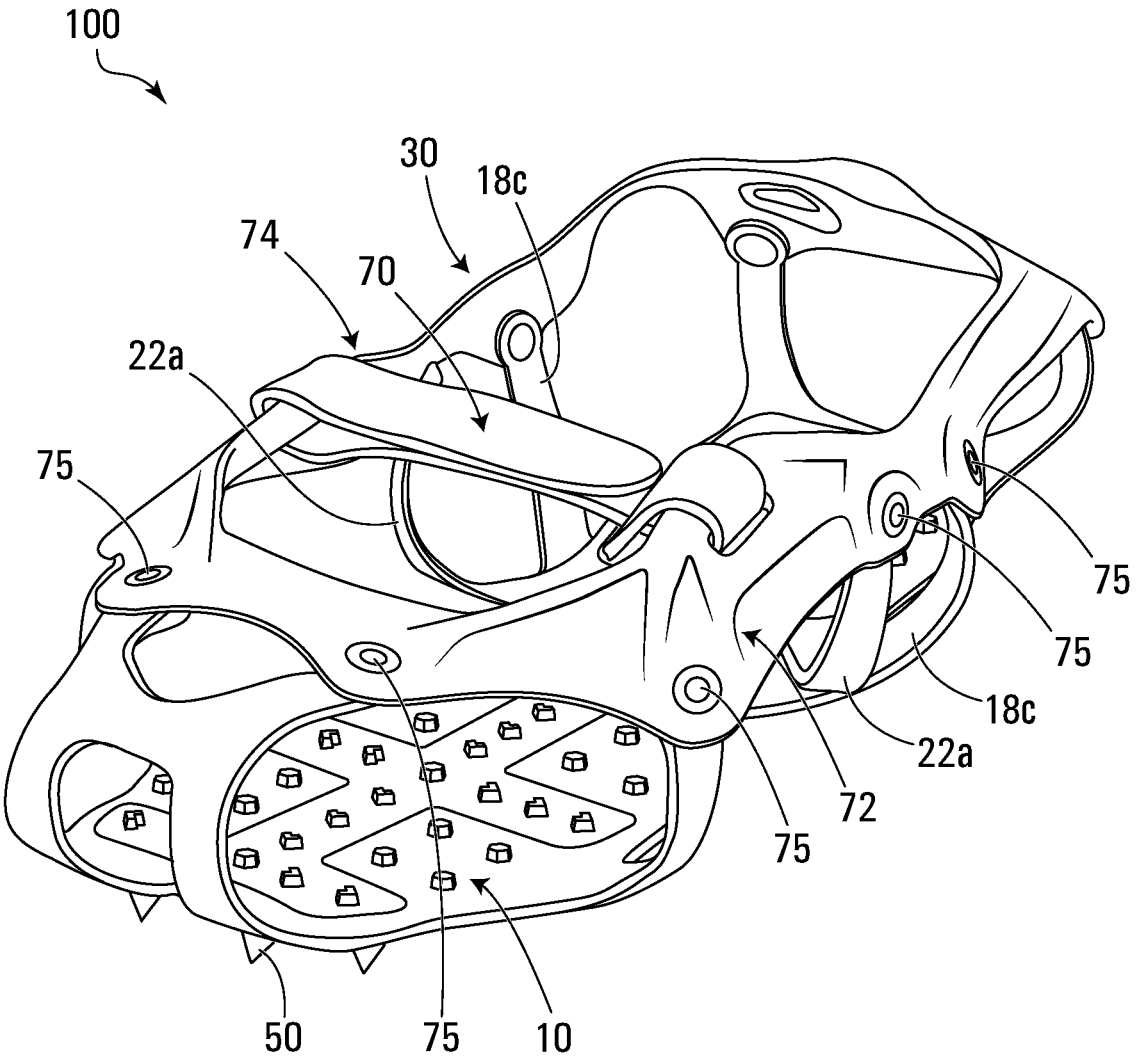
FIG. 1 shows a crampon according to an embodiment of the disclosure.

According to an embodiment of the disclosure, there is shown in FIG. 1 a crampon 100. Crampon 100 comprises generally a lower portion, which may be referred to as crampon base 10, connected to an upper portion which may be referred to as harness 30. A number of cleats 50 (not shown fully in FIG. 1) are partially embedded within crampon base 10 as will be described in detail below, and extend away from crampon base 10. As known in the art, cleats 50 provide improved traction for a user of crampon 100, such that the user may move more easily over uneven or slippery surfaces such as snow and ice.

Collectively, crampon base 10 and harness 30 define a space or volume within which a user may insert an item of footwear, such as a shoe or a boot. Crampon 100 may then be secured or tightened about the item of footwear by means of a securing device 70 extending between the left side 72 and the right side 74 of harness 30. In the present embodiment, securing device 70 is a Velcro® strap, although in other embodiments any other suitable securing device may be employed. For example, the Velcro® strap may be replaced with a hook or similar feature on each of the left and right sides 72, 74 of harness 30. The hooks may be engaged with each other by bringing closer together the left and right sides 72, 74 of harness 30, in order to tighten harness 30 around the item of footwear introduced within crampon 100.

Figure 2:
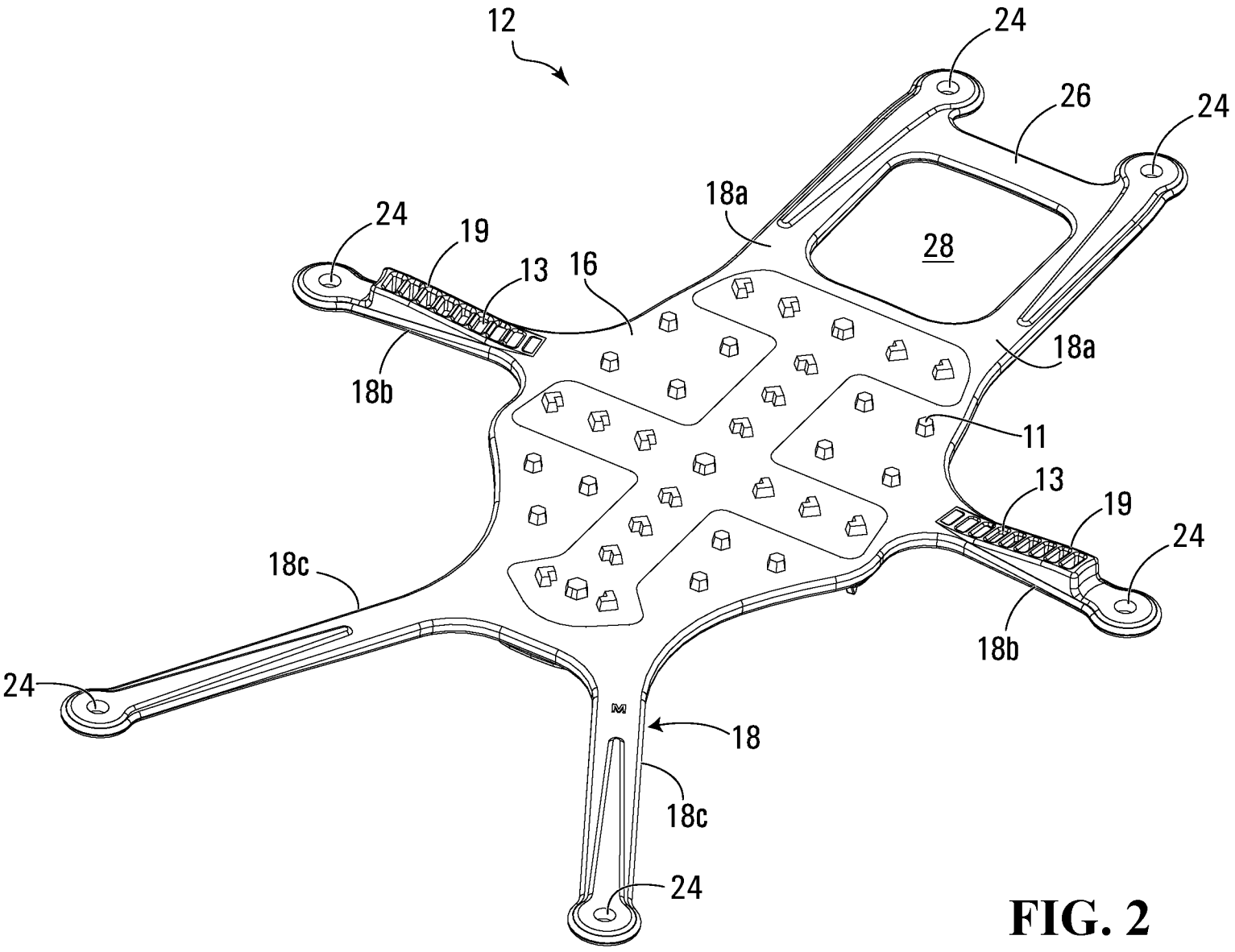
FIG. 2 is a top view of a front portion of a crampon base, according to an embodiment of the disclosure.
Figure 3:
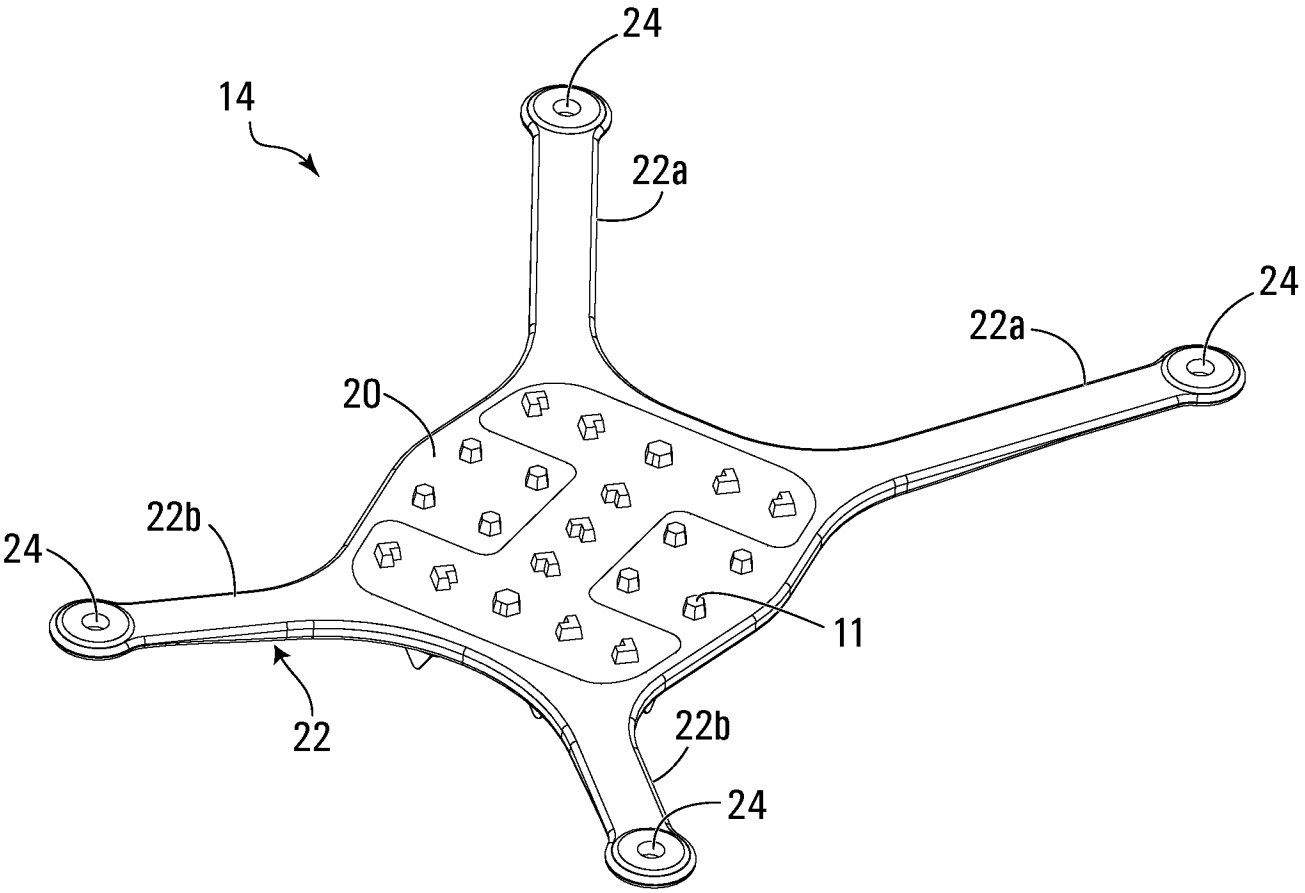
FIG. 3 is top view of a rear portion of a crampon base, according to an embodiment of the disclosure.

Turning to FIGS. 2 and 3, there are shown a flexible, front crampon base portion 12 and a flexible, rear crampon base portion 14 of crampon base 10. Front crampon base portion 12 comprises a central portion 16 with a number of front base straps 18 extending therefrom. In particular, front crampon base portion 12 includes two front base straps 18*a* extending from a front of central portion 16, a front base strap 18*b* extending from each of the left and right sides of central portion 16, and two front base straps 18*c* extending from a rear of central portion 16. Similarly, rear crampon base portion 14 comprises a central portion 20 with a number of rear base straps 22 extending therefrom. In particular, rear crampon base portion 14 includes a rear base strap 22*a* extending from each corner of a front of central portion 20, as well as a rear base strap 22*b* extending from each corner of a rear of central portion 20. In other embodiments, front crampon base portion 12 and rear crampon base portion 14 may include any suitable number of front and rear base straps 18, 22. In still other embodiments, front crampon base portion 12 and rear crampon base portion 14 may be integrally formed, such that crampon base 10 is made of a single unitary component.

As can be seen in FIG. 2, front base straps 18*b* include ramp-shaped thickened portions 19. Thickened portions 19 result in a thickness of front base straps 18*b* increasing from central portion 16 towards the ends of front base straps 18*b*. Thickened portions 19 include recesses 13 formed therein for reducing the weight of front base straps 18*b* as well as improving the ability of front base straps 18*b* to flex. In addition, thickened portions 19 relieve tension between the user's foot and the points at which front base straps 18*b* are attached to harness 30, by spacing the attachment point from the user's foot.

At the end of each front base strap 18 and each rear base strap 22 is located an aperture or eyelet 24. Gripping features 11, such as small studs, extend upwardly from each of central portion 16 and central portion 20. Gripping features 11 provide increased friction between crampon base 10 and an item of footwear received within crampon 100, thereby improving the grip between the item of footwear and crampon base 10. In addition, front base straps 18*a* are interconnected by a connecting strap 26 integrally formed with front base straps 18*a*, such that a toe box aperture 28 is defined for receiving a front or toe portion of an item of footwear received within crampon 100.

Figure 4A:
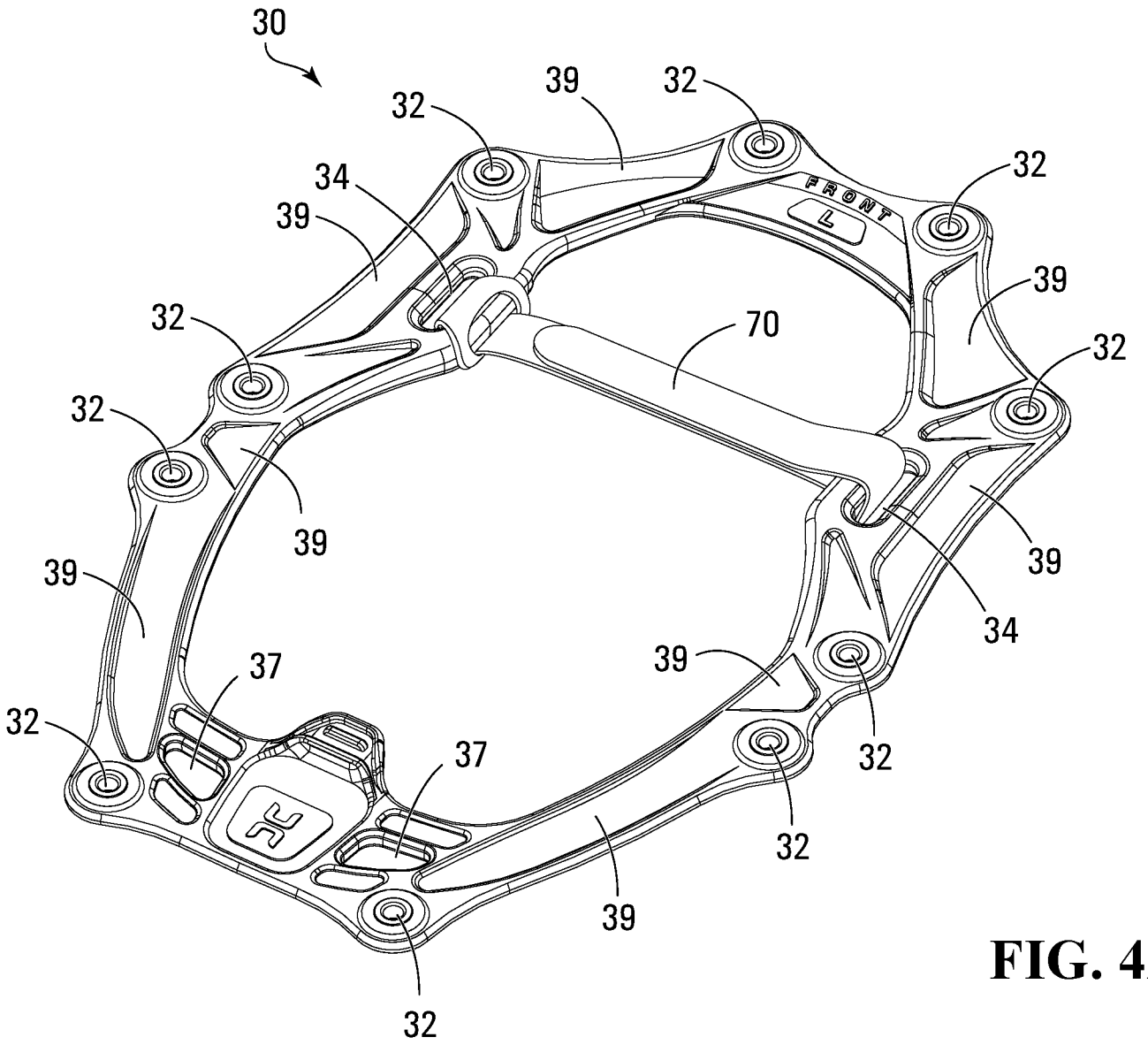
FIGS. 4A and 4B are top and bottoms views of a harness according to an embodiment of the disclosure.
Figure 4B:
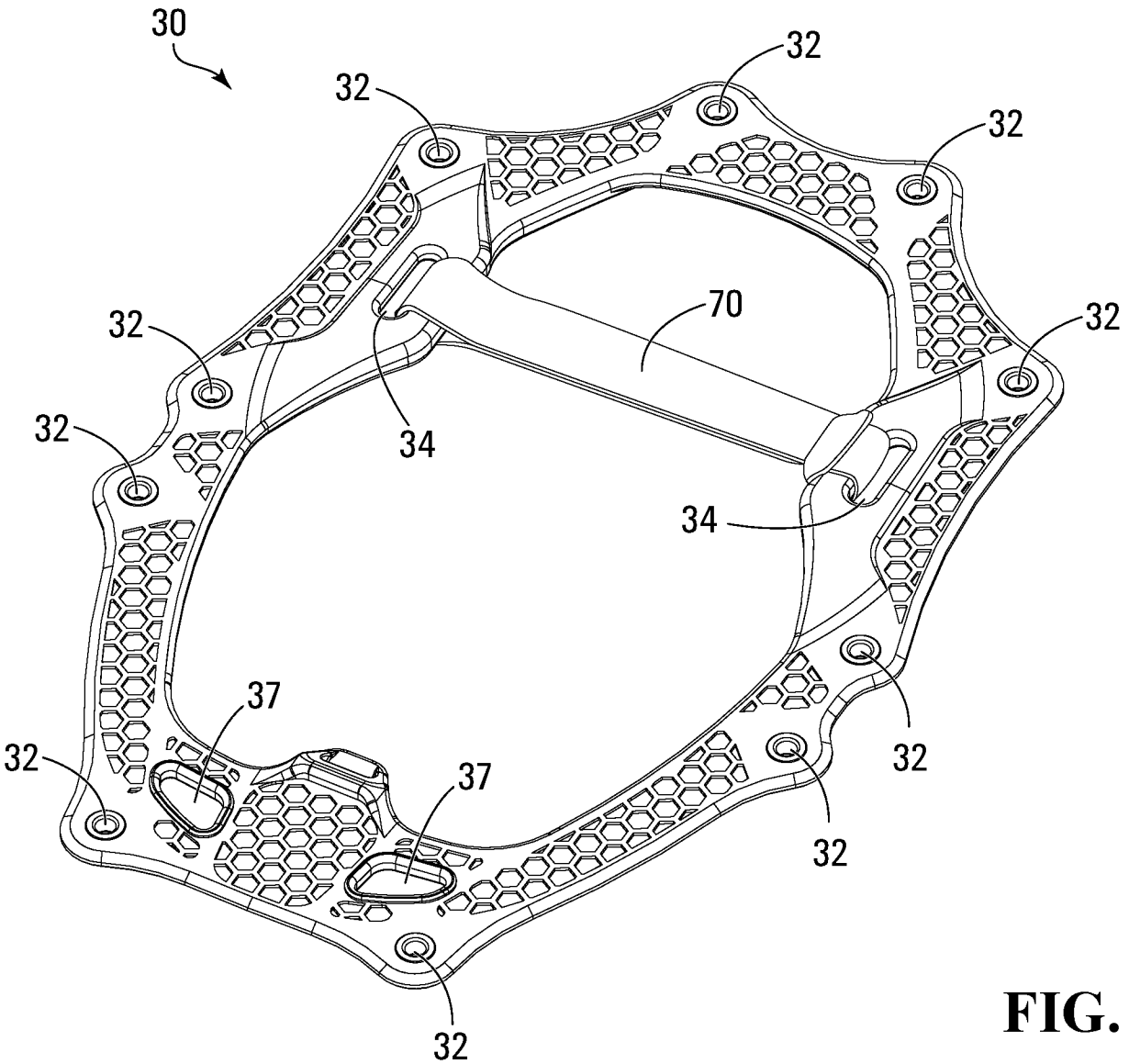

Turning to FIGS. 4A and 4B, there are shown top and bottom view of harness 30 in more detail. Harness 30 comprises a generally oval-shaped structure with a number of apertures or eyelets 32 formed along its periphery. The number of eyelets 32 in harness 30 corresponds to the number of eyelets 24 in crampon base 10. The frontal periphery of harness 30 comprises recessed edges between successive eyelets 32. On left side 72 and right side 74 of harness 30, harness 30 includes slots 34 for receiving the Velcro® strap of securing device 70. Harness 30 further includes a number of features for reducing the overall weight of harness 30 while improving the flexibility of harness 30. In particular, harness 30 includes a number of recessed areas 39 on a top surface of harness 30 (FIG. 4A). On the underside of harness 30 (FIG. 4B), harness 30 comprises a honeycomb structure of depressions formed therein, and apertures 37 formed within a rear portion of harness 30, also for reducing the overall weight of harness 30 while improving the flexibility of harness 30. Increasing the flexibility of harness 30 assists a user to stretch harness 30 when inserting their foot within crampon 100.

Turning to FIG. 5A, there are shown top and bottom sides of a cleat 50 for use with crampon 100, according to an embodiment of the disclosure. Cleat 50 comprises a generally cross-shaped cleat base 52 which includes a central hub 53, first members 52*a*, and second members 52*b* positioned perpendicularly to first members 52*a*. The cross shape of cleat base 52, as opposed to a traditional rectangular cleat base, provides improved stability for the user. Each member 52*a*, 52*b* comprises a linear portion 54 radiating outwardly from central hub 53. In addition, second members 52*b* include curved portions 55 extending from linear portions 54. At the end of each curved portion 55, a spike 56 projects downwardly from second member 52*b*. In particular, due to the curvature of each second member 52*b*, by virtue of curved portions 55, each spike 56 projects downwardly at an angle relative to a line L defined by first members 52*a*. Each spike 56 comprises a downwardly projecting portion and a pointed end 57 at an extremity thereof. Cleat base 52 further includes a number of apertures 58 formed therein.

FIG. 5B shows an alternative or additional cleat 60 that may be used with crampon 100. Unlike cleat 50, cleat 60 has three prongs or spikes 61 that extend from a cleat base 62. Similarly to cleat base 52, cleat base 62 comprises a central hub 63 and three spokes or members radiating from central hub 63. Cleat base 62 also includes a number of apertures 64 formed therein.

In some embodiments, a distance separating spikes 56 of cleat 50 is about 2 cm. In addition, by only having two spikes 56 on cleat 50 as opposed to more than two spikes, cleat 50 is at a lower risk of snowballing than cleat 60 (which can be a common problem with crampons), in other words having snow or ice stick to cleat base 52.

Figure 6B:
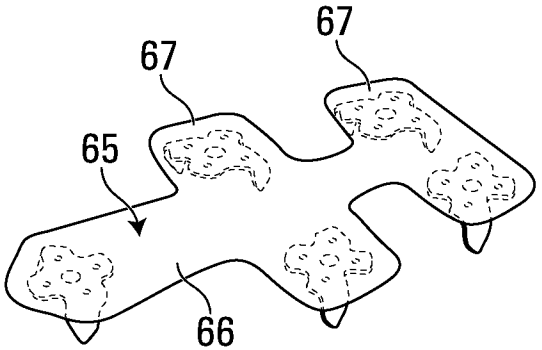
FIGS. 6A-6D show stages in the making of the front crampon base portion of FIG. 2, according to an embodiment of the disclosure.
Figure 6D:
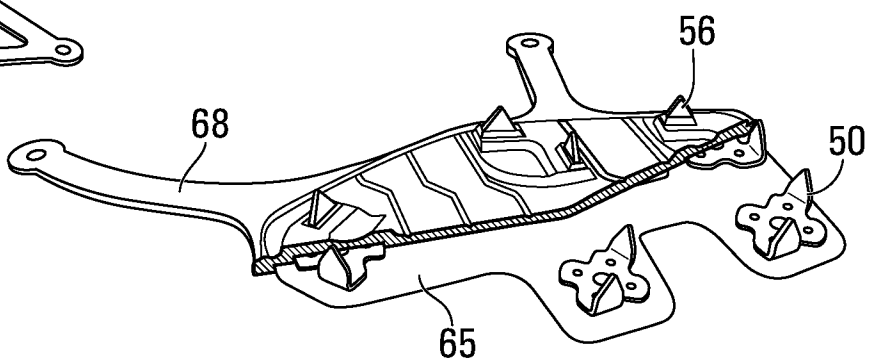
Figure 6A:
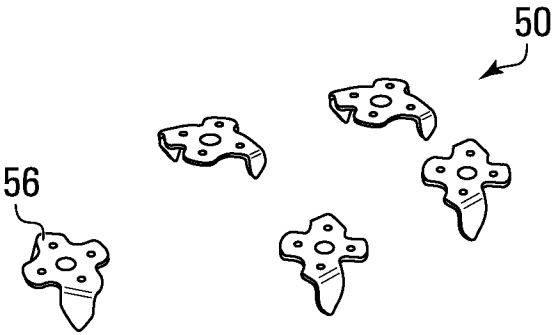

In accordance with an embodiment of the disclosure, FIGS. 6A-6D show steps taken in a molding process for producing front crampon base portion 12 of crampon base 10. While front crampon base portion 12 of FIGS. 6A-6D is not shaped exactly as front crampon base portion 12 of FIG. 2, the steps shown in FIGS. 6A-6D may be equally applied to front crampon base portion 12 of FIG. 2. In FIG. 6A, cleats 50 are positioned in a mold (not shown) in predetermined positions and in predetermined orientations relative to one another, with spikes 56 pointed downwards. In FIG. 6B, an elastomeric pad 65 is provided over cleats 50 such that pad 65 covers a top of each cleat base 52 of cleats 50. Pad 65 assists in stabilizing cleats 50 relative to the mold and, in the case of front crampon base portion 12, comprises a vertical strip 66 bisected by two horizontal strips 67. Cleats 50 are located on the underside of ends of strips 66 and 67. Pad 65 comprises thermoplastic polyurethane, although the disclosure extends to other suitable types of material.

Figure 6C:
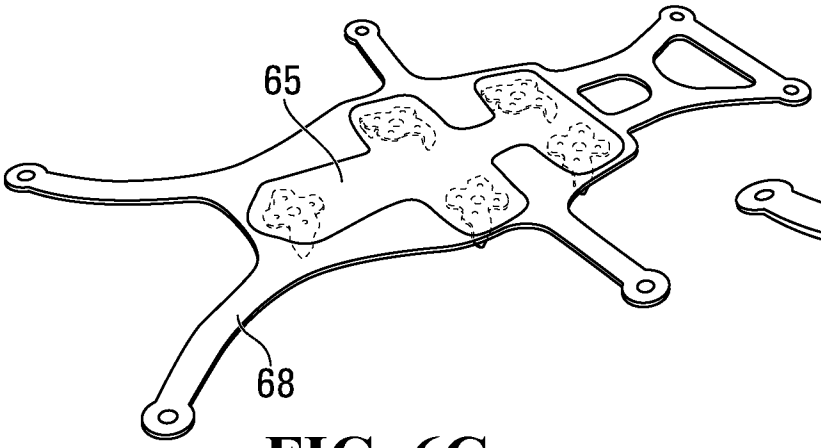

In FIG. 6C, an elastomer 68 is injected into the mold to form the remaining portion of front crampon base portion 12, including front base straps 18. Due to the shape of the mold, cleat base 52 of each cleat 50 is embedded within front crampon base portion 12. Specifically, cleat base 52 of each cleat 50 is sandwiched between pad 65 and injected elastomer 68. Thus, only spikes 56 protrude from the underside of front crampon base portion 12, as can be seen in FIG. 6D. Apertures 58 formed within each cleat base 52 are filled with the injected elastomer 68, and thus each cleat 50 is more firmly embedded within front crampon base portion 12 than if cleat base 52 did not include apertures 58. The process is repeated for rear crampon base portion 14. The shape of the upper, elastomeric pad used for rear crampon base portion 14 can be seen in FIG. 3. Elastomer 68 also comprises thermoplastic polyurethane. However, since pad 65 supports cleats 50 during use of crampon 100, pad 65 is formed of a harder thermoplastic polyurethane than that of elastomer 68.

Figure 7A:
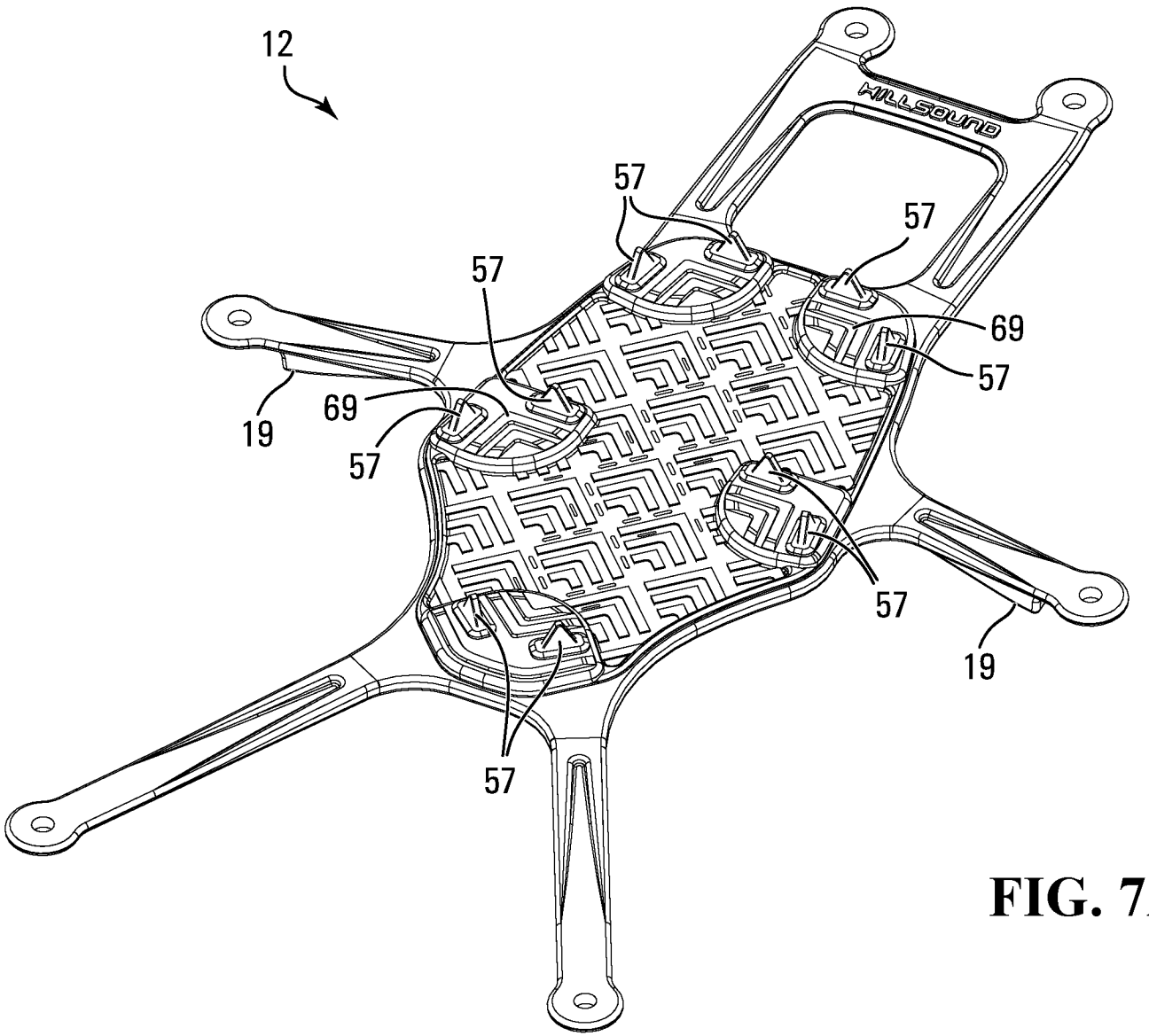
FIGS. 7A and 7B are bottom views of the front and rear crampon base portions of FIGS. 2 and 3, according to an embodiment of the disclosure.
Figure 7B:
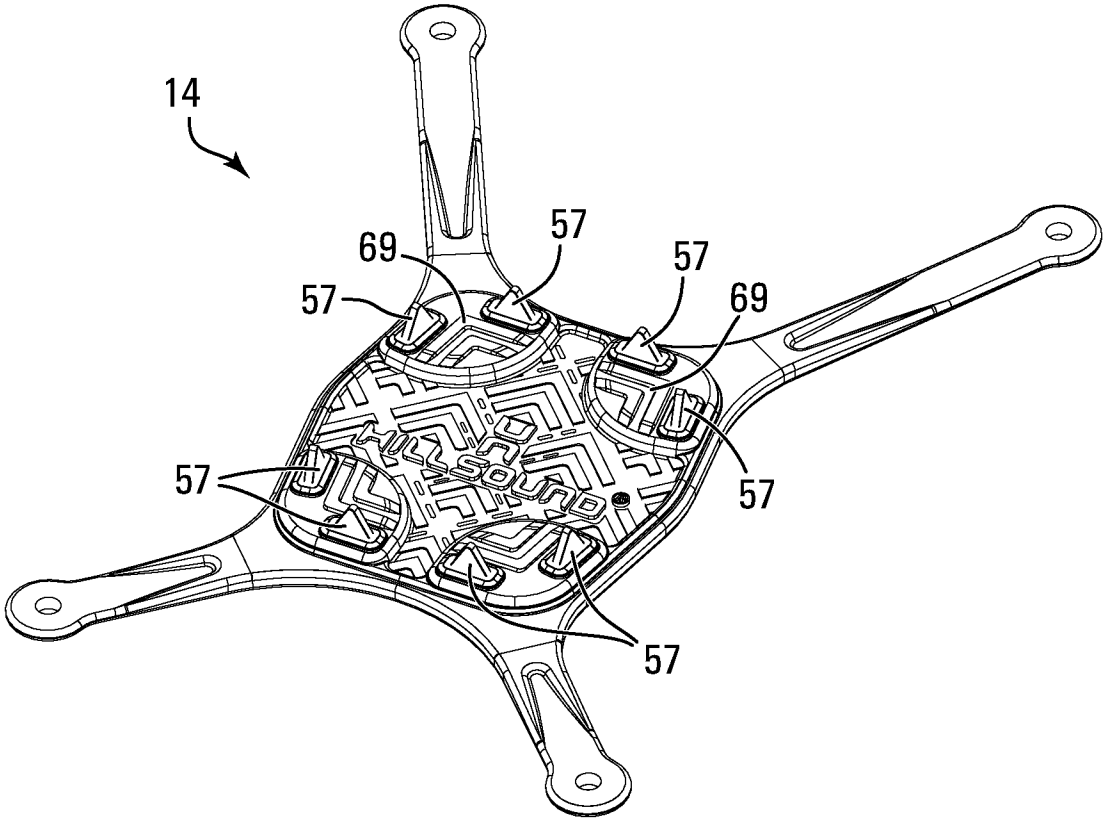

Turning to FIGS. 7A and 7B, there are shown the undersides of front crampon base portion 12 and rear crampon base portion 14. Pointed ends 57 of spikes 56 can be seen protruding from front crampon base portion 12 and rear crampon base portion 14. Recesses 69 can be seen in the mold of elastomer 68 at the location of each cleat 50. Recesses 69 assist in allowing front crampon base portion 12 and rear crampon base portion 14 to flex during use.

Returning to FIG. 1, crampon 100 is formed by connecting front crampon base portion 12 and rear crampon base portion 14 to harness 30 at multiple attachment points. In particular, the eyelet 24 of each front base strap 18 and each rear base strap 22 is aligned with a corresponding eyelet 32 of harness 30. When aligned, a fastening device such as a rivet 75 is inserted within the eyelets 24, 32, thereby affixing harness 30 to crampon base 10. Although other forms of fastening devices may be used, rivets 75 may be advantageous in that rivets 75 may provide a more durable connection than traditional links. Furthermore, rivets 75 can be constructed to have a relatively low profile to reduce friction with the user's foot during use of crampon 100.

As can also be seen in FIG. 1, front base straps 18*c* of front crampon base portion 12 overlap with rear base straps 22*a* of rear crampon base portion 14. The overlap may assist in tensioning crampon 100 to the user's foot by pulling front crampon base portion 12 backward and front crampon base portion 14 forward, helping to secure crampon 100 in place.

In some embodiments, crampon base 10 is more rigid and more durable than harness 30, whereas harness 30 is more flexible to thereby facilitate a user positioning their foot within crampon 100. In some embodiments, harness 30 is made of thermoplastic elastomer, whereas crampon base 10 is made of thermoplastic polyurethane While the disclosure has been described in connection with specific embodiments, it is to be understood that the disclosure is not limited to these embodiments, and that alterations, modifications, and variations of these embodiments may be carried out by the skilled person without departing from the scope of the disclosure. It is furthermore contemplated that any part of any aspect or embodiment discussed in this specification can be implemented or combined with any part of any other aspect or embodiment discussed in this specification.

The invention claimed is:

1. A crampon comprising:

a crampon base for fitting to an underside of an item of footwear; and a harness extending from the crampon base and defining with the crampon base a space for receiving the item of footwear, wherein the crampon base comprises at least one cleat having:

a cleat base embedded within the crampon base; and one or more spikes extending from the cleat base, wherein the crampon base further comprises one or more base straps each attached to the harness, and wherein at least one of the one or more base straps comprises a ramp-shaped thickened portion.

2. The crampon of claim 1, wherein the cleat base is cross-shaped.

3. The crampon of claim 2, wherein the cleat base comprises a central portion and arms extending from the central portion, and wherein each spike extends from an end of one of the arms.

4. The crampon of claim 3, wherein the cleat base comprises four arms extending from the central portion and at right angles to adjacent arms, and wherein each spike is angled relative to a line defined by a pair of opposing ones of the arms.

5. The crampon of claim 4, wherein the one or more spikes comprise a pair of spikes extending from ends of opposing ones of the arms.

6. The crampon of claim 3, wherein each spike extends perpendicularly from an end of one of the arms.

7. The crampon of claim 3, wherein at least one of the arms comprises a linear portion extending from the central portion and a curved portion extending from the linear portion.

8. The crampon of claim 7, wherein one of the one or more spikes extends from an end of the curved portion.

9. The crampon of claim 1, wherein the cleat base comprises one or more apertures formed therein.

10. The crampon of claim 1, wherein the one or more spikes comprise a pair of spikes.

11. The crampon of claim 1, wherein the harness is attached to the crampon base using one or more fasteners.

12. The crampon of claim 1, further comprising a connector attached to opposite sides of the harness and configured to tighten the harness about the item of footwear.

13. The crampon of claim 1, wherein the crampon base comprises a front crampon base portion for fitting to a sole of the item of footwear, and a rear crampon base portion for fitting to a heel of the item of footwear.

14. The crampon of claim 13, wherein the crampon base comprises five cleats embedded in the front crampon base portion, and four cleats embedded in the rear crampon base portion.

15. The crampon of claim 13, wherein the front crampon base portion and the rear crampon base portion each comprise respective ones of the one or more base straps attaching the crampon base to the harness, and wherein at least one of the base straps of the front crampon base portion overlaps with at least one of the base straps of the rear crampon base portion.

16. The crampon of claim 1, wherein the crampon base is molded around the cleat base.

17. The crampon of claim 1, wherein the crampon base comprises a first elastomer, and wherein the harness comprises a second elastomer different from the first elastomer.

18. The crampon of claim 17, wherein the first elastomer is more durable or less flexible than the second elastomer.

19. The crampon of claim 1, wherein the ramp-shaped thickened portion comprises recesses formed therein for improving an ability of the at least one of the one or more base straps to flex.

20. The crampon of claim 1, wherein the cleat base is wholly embedded within the crampon base.

21. The crampon of claim 1, wherein the crampon base is molded around the cleat base with the cleat base sandwiched between an elastomeric pad and an injected elastomer.

22. The crampon of claim 21, wherein the elastomeric pad is formed of a harder thermoplastic polyurethane than that of the injected elastomer.

* * * * *